United States Patent [19]

Beckerer, Jr.

[11] 4,280,434

[45] Jul. 28, 1981

[54] COVER PLATE CONSTRUCTION FOR BOAT DECKS

[76] Inventor: Frank S. Beckerer, Jr., 40 Dock Rd., Milford, Conn. 06460

[21] Appl. No.: 72,884

[22] Filed: Sep. 6, 1979

Related U.S. Application Data

[63] Continuation-in-part of Ser. No. 909,396, May 25, 1978, Pat. No. 4,246,859.

[51] Int. Cl.[3] ..... B63B 19/00

[52] U.S. Cl. ..... 114/174; 114/173; 114/201 R; 215/329; 220/288

[58] Field of Search ..... 220/288, 296; 215/329; 114/173, 174, 177, 176, 178, 201 R, 201 A, 203

[56] References Cited

U.S. PATENT DOCUMENTS

| | | | |
|---|---|---|---|
| 999,688 | 8/1911 | Winton | 114/174 |
| 1,934,356 | 11/1933 | Rice | 220/288 |
| 2,131,762 | 10/1938 | Smith | 114/174 |
| 2,146,587 | 2/1939 | Merolle | 220/296 |
| 2,818,204 | 12/1957 | Henchert | 220/296 |
| 3,022,917 | 2/1962 | Montgomery | 220/296 X |
| 3,223,269 | 12/1965 | Williams | 215/329 |
| 3,432,069 | 3/1969 | Craig | 220/288 |
| 4,065,026 | 12/1977 | Williams | 220/288 |

FOREIGN PATENT DOCUMENTS

| | | | |
|---|---|---|---|
| 352226 | 3/1961 | Switzerland | 220/288 |
| 24338 | of 1889 | United Kingdom | 114/174 |
| 1488850 | 9/1976 | United Kingdom | 220/288 |

*Primary Examiner*—Trygve M. Blix
*Assistant Examiner*—D. W. Keen
*Attorney, Agent, or Firm*—H. Gibner Lehmann; K. Gibner Lehmann

[57] ABSTRACT

A threaded access cover plate construction for boat decks, comprising a threaded fitting which is adapted to be secured to the deck, and a screw closure receivable in the fitting. Both the fitting and the closure have cooperable buttress-type threads which are dimensioned such that there is a relatively loose fit between the two parts. The rim of the fitting is in the form of a resilient upstanding skirt constituted of deformable material, the skirt being capable of yielding at selected points, due to its engagement by a centering shoulder of the closure. The yielding of the skirt permits improved seating of the closure, by minimizing the effect of interference between high points at the regions of contact of the two parts. Accordingly, a highly leak-resistant seal is established, even when the fitting or the closure has become slightly warped, or the fitting has been stressed to some extent by virtue of its being secured to the deck.

12 Claims, 5 Drawing Figures

COVER PLATE CONSTRUCTION FOR BOAT DECKS

CROSS REFERENCES TO RELATED APPLICATIONS

The present application is a continuation-in-part of my copending application, U.S. Ser. No. 909,396 filed May 25, 1978, entitled COVER PLATE CONSTRUCTION FOR BOAT DECKS, now U.S. Pat. No. 4,246,859.

BACKGROUND

This invention relates generally to removable cover plate constructions for installation in the decks of boats, and more particularly to constructions employing threaded cover plates which can be readily installed or removed to provide quick access to areas below the deck such as storage spaces, the bilge, and areas where shut-off valves, instruments, and the like are located. Where such plates were employed with instrument gauges, the plates were sometimes constituted of transparent material such that the gauges could be read with the cover plate still in place.

In the past a number of deck cover constructions employing a deck fitting and a cooperable closure member have been proposed and produced, and have met with varying degrees of success. Several problems were encountered, however, with the prior art constructions. Where the closure member and the deck fitting had cooperable threads of conventional construction, there was a likelihood of binding of the two parts in the event that either became warped. When the parts were constituted of molded plastic, a limited amount of such warping was inevitable as the plastic cured. The deck fitting part, being generally of annular configuration, sometimes assumed a slightly egg-shaped configuration, causing interference or a poor fit between the threads, and resulting in binding as the closure member was screwed in place.

The deck fitting part usually had an apertured annular mounting flange by which it could be screwed in place on the deck. In the event that the latter was not prefectly flat or planar, but instead slightly skewed, the fitting tended to follow this contour, thereby assuming a bowed configuration. This also caused interference problems with the cooperable threads. In addition, it was usually considered important to provide a good sealing surface on the closure part that was engageable with the cooperable surfaces of the deck fitting. When the latter was bowed, such surfaces did not meet uniformly at all points around the periphery of the closure, resulting in a poor fit and the likelihood of leakage of water past the cover and into the area beneath the deck.

There were also cost disadvantages involved in providing, on such fittings, threads extending beyond 360° in spiral circumference, since the provision of such threads made molding of the parts difficult. A suitable location for a parting line in a pair of mold cavities is often difficult or impossible to find when it is desired to mold each of the parts in a single step or operation. In addition, where relatively small gauge threads were involved, there was a likelihood of large grains of sand or dirt becoming lodged in the areas around the threads, resulting in undesirable binding or seizing thereof.

SUMMARY

The above drawbacks or disadvantages of prior access cover plate constructions for boats are obviated by the present invention, which has for an object the provision of a novel and improved access cover construction which is both simple in its structure and reliable in operation over extended periods of use and under adverse conditions.

Yet another object of the invention is the provision of an access cover as above, wherein the parts are constituted mostly of molded plastic and wherein a highly leak-resistant seal is obtainable even in the event that the parts undergo a slight warping due to curing of the plastic, or due to slight imperfections in the deck of the boat with which the cover is used.

Still another object of the invention is the provision of an improved access cover construction wherein the individual parts can each be molded as a single integral piece, in simple cavities and at a low cost.

A further object of the invention is the provision of an improved access cover construction wherein the likelihood of binding of the parts is greatly minimized, and wherein the chance of particles of sand or dirt becoming lodged in the cooperable thread formations of the parts is substantially reduced.

Yet another object of the invention is the provision of an access cover construction as above, wherein an improved seal is obtainable between the parts, by virtue of one of the parts having a relatively thin, resilient sealing skirt which is yieldable, so as to minimize the effect of interference between high spots at the locations of the cooperable sealing surfaces of the access cover parts.

The above objects are accomplished by the provision of a threaded access cover plate construction for the deck of a boat, comprising a novel deck fitting and means thereon engageable with the deck for securing the fitting thereto in sealing relation therewith, together with a unique screw closure that is receivable in the deck fitting. The screw closure and fitting have cooperable, mating buttress-type threads which are engageable when the closure is screwed into the fitting. The fitting includes a rim in the form of an upstanding yieldable and resilient skirt, which is engaged by a centering shoulder on the closure. The threads are so dimensioned as to provide excessive slop and looseness between the fitting and closure, so as to enable lateral shifting of the closure to occur when it is screwed into the fitting. By virtue of such lateral shifting, the centering shoulder can precisely seat into the rim of the fitting.

In addition, the skirt, being resilient can yield outwardly at selected locations, due to camming engagement by the centering shoulder of the closure. This permits an improved seating of the closure, and results in a better seal being made possible between the closure and the fitting, even in the event that a slight warping or distortion of the latter has occurred.

Other features and advantages will hereinafter appear.

In the drawings, illustrating a preferred embodiment of the invention:

Figure 1:
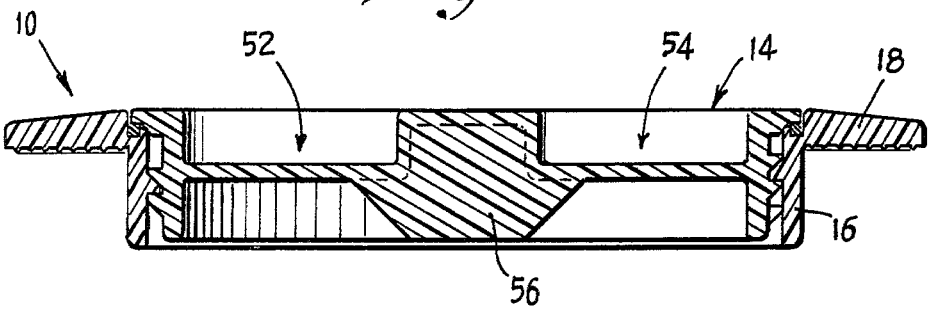
FIG. 1 is a vertical section of the improved threaded access cover plate construction of the present invention, comprising a deck fitting and a screw closure received therein.
Figure 3:
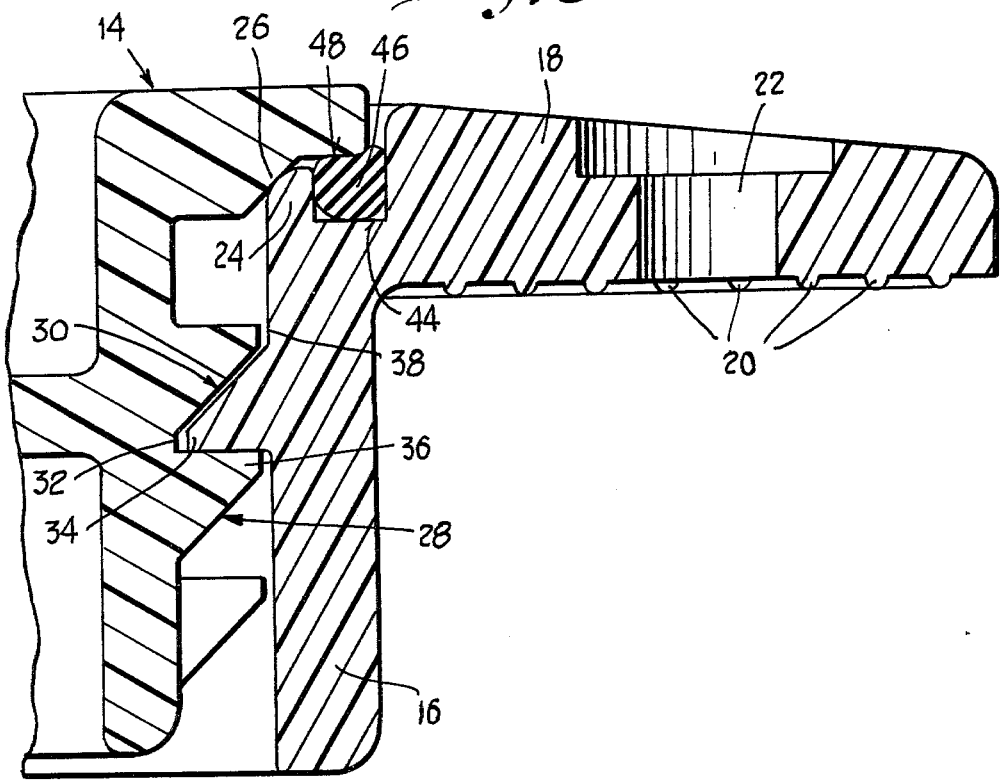
FIG. 3 is an enlarged fragmentary section of a portion of the cover plate construction of FIG. 1, particularly showing the thread forms and sealing means associated therewith.

Referring to FIGS. 1 and 3 and in accordance with the present invention there is provided a novel and improved access cover plate construction for the deck of a boat, generally designated by the numeral 10 and comprising an annular deck fitting 12 and a circular screw closure 14 receivable in the fitting. The fitting 12 comprises a tubular body 16 which is adapted to extend into a hole in the deck, and an annular mounting flange 18 engageable with the upper surface of the deck surrounding the hole.

Figure 4:
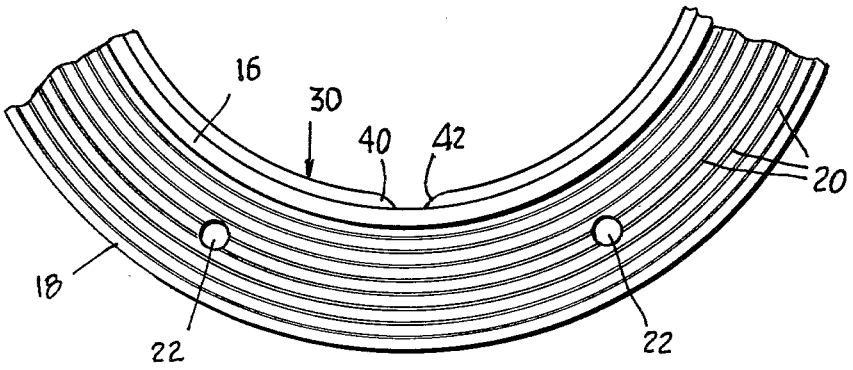
FIG. 4 is a fragmentary bottom plan view of the deck fitting part per se, of the cover plate construction of FIG. 1.

As shown in FIGS. 3 and 4, the mounting flange 18 has a series of circumferential ribs 20 on its underside, and multiple mounting holes 22 to receive wood screws (not shown) which secure the fitting to the deck. Suitable sealing compound can be applied to the underside of the flange, over the ribs, and the fitting then installed to provide a water-tight seal with respect to the deck.

In accordance with the present invention there is provided a novel sealing arrangement between the screw closure and deck fitting, involving a relatively thin, yieldable upstanding annular skirt or rim 24 constituted of resilient material, a centering shoulder on the closure, and the provision, on both parts, of cooperable buttress-type threads so dimensioned as to provide a relatively loose fit which permits limited self-alignment of the closure to occur as the latter is tightened.

The cooperable buttress-type threads are indicated by the numerals 28 and 30. As shown in FIG. 3, they have corresponding helical surfaces of engagement wherein the axes of the helices are coincident with one another and with the axes of both the closure and the fitting. In addition, there is provided a substantial amount of slop and looseness between the threads of the two parts such that as the closure is screwed into the fitting, it can shift laterally of its axis as determined by the engagement of the centering shoulder 26 of the closure and the rim 24. In particular, FIG. 3 illustrates that the diameter of the external thread 28 at its root 32 is significantly less than the diameter of the internal thread 30 at its crest 34. Similarly the diameter of the external thread 28 is at its crest 36 is seen to be significantly less than the diameter of the internal thread 30 at its root 38. The resulting clearance spaces give rise to the capability of the closure to undergo the lateral shifting mentioned above, as the closure is tightened.

Figure 5:
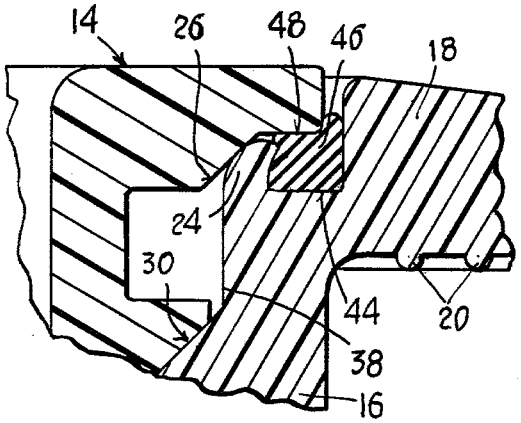
FIG. 5 is a view like FIG. 3 except showing part of the upstanding skirt of the fitting being urged radially outward under the camming action of the centering shoulder of the closure.

Further, in accordance with the invention the upstanding skirt is made relatively thin, and constituted of resilient plastic material such that it can yield radially outwardly at selected locations under the camming action of the centering shoulder 26. The yieldability of the skirt 24 permits improved seating of the closure 14 in the fitting 12 by minimizing the undesirable effect of interference between any high spots at the locations of the cooperable sealing surfaces of the closure and fitting. Such high spots might be the result of stressing of the deck fitting when the latter was secured in place on the deck, or warping of the parts, or possibly even stresses in the parts resulting from the curing step of the molding process. Were the skirt 24 made generally rigid, the closure could be tightened only to the extent where the high points of the cooperable surfaces of the closure and the fitting came into contact, possibly leaving other areas of the cooperable surfaces spaced apart a slight extent. By making the skirt 24 relatively thin and of resilient material, the skirt 24 can be urged radially outwardly at those points on the skirt which are the first to engage the centering shoulder, and the closure tightened a further extent such that virtually all points along the generally circular line of contact between the skirt 24 and shoulder 26 are brought into sealing engagement with one another. Where the skirt is molded as indicated in FIG. 3, it is seen to lie generally along a cylindrical surface, and such yielding as described above occurs in directions substantially transverse to this cylindrical surface. FIG. 5 shows one portion of the skirt 24 in its stressed condition, having been shifted radially outwardly under the camming action of the centering shoulder 26.

Such a construction has been found to be very effective in establishing a primary seal between the rim or skirt 24 and shoulder 26. In the event that the mounting flange 18 has been slightly distorted by virtue of its being screwed down to a non-planar or warped section of the deck, the particular self-centering configuration of the shoulder 26, as well as the yieldability of the thin, flexible skirt 24, effect a proper, optimum positioning of the closure as well as establishing a 360° seal, in order to compensate for such warping or distortion. In the event that one or both of the sealing surfaces 24 or 26 are slightly out of round, following curing, the above construction has been found to minimize the adverse effects resulting therefrom. Accordingly, the likelihood of undesirable leakage is greatly reduced. In addition, there are eliminated other problems associated with binding of theads due to distortion of one of both of the cooperable threaded parts, resulting either from improper curing or from stress due to installation of the fitting on the deck surface.

Further in accordance with the present invention, the thread 30 of the fitting is constituted as a single helix extending through an angle of just under 360°. The beginning and the end of the thread are particularly shown in FIG. 4, and designated 40, 42 respectively. The provision of a single thread makes possible the molding of the fitting in a single two-part cavity, with the parting line extending through the crest of the thread 30 from its beginning 40 to its end 42. Reduced manufacturing cost is thus realized. In addition, by the provision of a single buttress-type thread 40 there is a relatively small area of engagement thereof with the closure thread 28. Accordingly, there is greatly minimized the likelihood of undesirable binding of the threads, due to sand or dirt becoming permanently trapped therebetween, or due to the formation of salt crystal deposits on the threads. Smoother operation and virtually complete freedom from seizure thereby result. Moreover, where the single helical thread is carried by the fitting which is secured to the deck, there is encountered less difficulty in keeping the thread clean, since there are no "grooves" between adjacent thread crests, in which dirt can become trapped. Accordingly, any foreign matter which does become lodged in the vicinity of this single thread can be quickly wiped away with a cloth or towel. On the other hand, the closure part can still be provided with a multiple thread, since it is more readily accessible due to the fact that it can be completely removed from the deck fitting, and any foreign matter thereafter wiped or brushed away, as required.

Further in accordance with the invention there can be provided an optional secondary seal between the closure 14 and the fitting 12. In accomplishing this the latter has an annular peripheral groove 44 in which there is received a resilient sealing gasket 46. The gasket is adapted to be engaged and somewhat flattened by a peripheral sealing surface 48 on the closure when the latter is tightened. The amount of distortion of the gasket is limited somewhat by the engagement of the shoulder 26 and rim 24. Accordingly, excessive flattening of the gasket does not occur; such flattening otherwise might adversely affect the sealing capability of the gasket, since excessive deformation thereof might conceivably give rise to the taking of a "set".

As shown in FIGS. 3 and 5, the groove 44 is formed by the skirt 24 and the adjacent parts of the fitting 16. The groove thus lies generally outside the skirt. At such time as there occurs radially outward yielding of the skirt 24, the mouth of the groove 44 is narrowed somewhat, but not sufficiently to cause any substantial compression or distortion of the gasket 46. The groove is thus seen to constitute a clearance area into which the skirt 24 can be urged, as well as providing a seat to hold the gasket 46 against accidental dislodgement.

Figure 2:
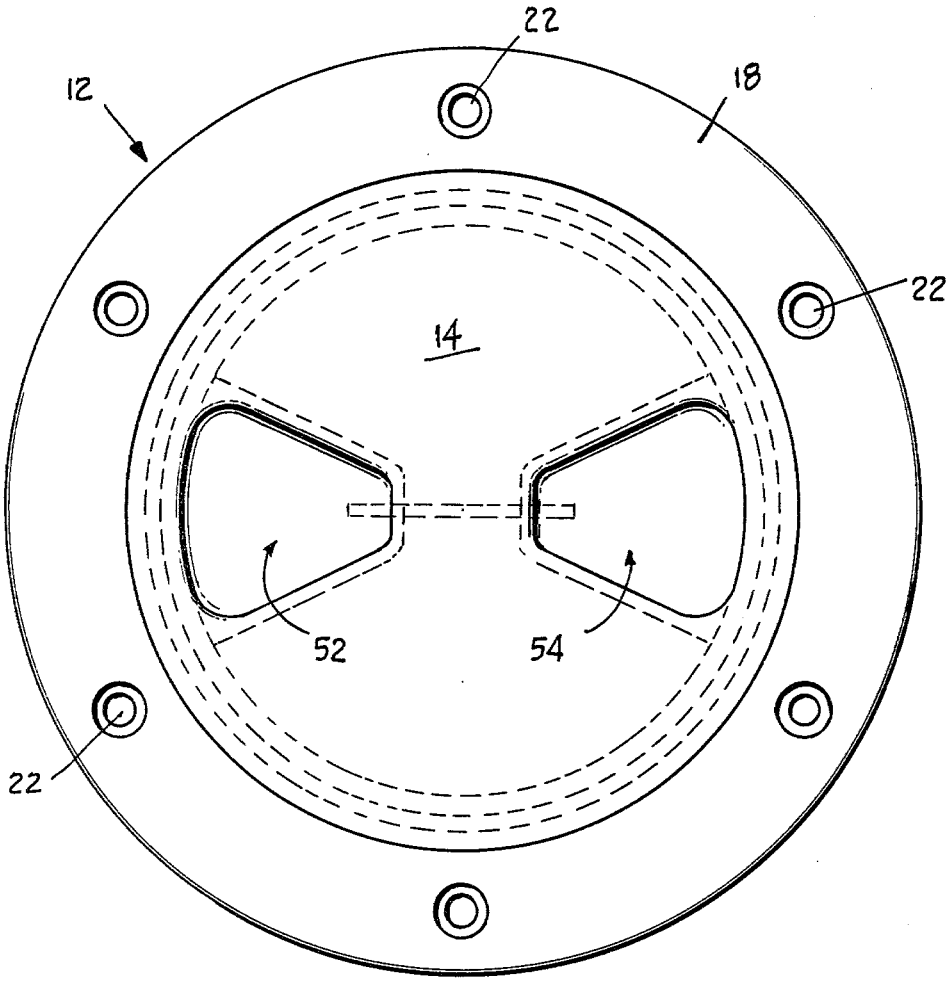
FIG. 2 is a top plan view of the cover plate construction of FIG. 1.

As particularly illustrated in FIGS. 1 and 2, on the closure there are provided means defining a pair of finger engageable notches 52, 54 to facilitate grasping the closure during opening or closing movement. Also, extending downward from the closure is an integral stiffening rib 56, for added rigidity and strength.

In addition to the advantages of smoothness of operation and freedom from binding mentioned above, the present construction enjoys the advantage of low overall cost, since the deck fitting 12 can be molded of plastic as a single integral piece, the same being true of the closure 14. The gasket 46 may take the form of a simple O-ring as shown, and can be merely pressed into place following curing of the fitting. Also, installation can be readily accomplished, all without the need for special tools, skilled personnel, or the like.

The device is thus seen to represent a distinct advance and improvement in the technology of boat accessories.

Each and every one of the appended claims defines a distinct aspect of the invention separate from the others, and each claim is accordingly to be treated in this manner when the prior art devices are examined in any determination of novelty or validity. Variations and modifications are possible without departing from the spirit of the invention.

I claim:

1. A threaded access cover plate construction for the deck of a boat, comprising in combination:

(a) a deck fitting, (b) a screw closure receivable in the deck fitting, (c) said fitting and screw closure having cooperable, mating buttress-type threads adapted to engage one another when the closure is screwed into the fitting, (d) means defining a rim on the fitting, (e) means defining a centering shoulder on said closure, cooperable with said rim, (f) said cooperable buttress-type threads being dimensioned to provide excessive slop and looseness of enabling lateral shifting of the closure with respect to the fitting, whereby the centering shoulder of the closure can precisely seat into the rim of the fitting when the closure is screwed into the latter, and (g) mounting means on the fitting, engageable with the boat deck, for securing the fitting thereto in sealing relation therewith, (h) said rim being constituted as an upstanding annular skirt of deformable material, defining with other outer portions of the fitting, a substantially annular groove such that portions of the skirt can be shifted radially outward and into the groove by an extent, due to their engagement by the centering shoulder of the closure, (i) said radially outward shifting of the skirt into the groove enabling improved seating of the centering shoulder on the annular skirt, thereby giving rise to an effective seal between the two parts.

2. The invention as defined in claim 1, wherein:

(a) said centering shoulder has a substantially conical configuration, adapted to seal against said rim when the closure is screwed into the fitting.

3. The invention as defined in claim 1, and further including:

(a) a gasket, carried in said groove, (b) said closure having an annular sealing surface engagement with the gasket to provide a supplementary seal therewith when the closure is screwed into the fitting.

4. The invention as defined in claim 3, wherein:

(a) said gasket is deformed and flattened somewhat by the closure sealing surface as the closure is tightened, (b) the engagement of said rim and centering shoulder limiting the deformation of the gasket by the sealing surface, so as to minimize the likelihood of the gasket taking a set.

5. The invention as defined in claim 1, and further including:

(a) means on said closure providing a finger-engageable notch to facilitate its installation or its removal from the fitting.

6. The invention as defined in claim 1, wherein:

(a) said fitting comprises a tubular body adapted to be received in a hole in the deck, (b) said fitting securing means comprising an annular mounting flange engageable with the upper surfaces of the deck which surround said hole.

7. The invention as defined in claim 6, wherein:

(a) said mounting flange comprises multiple sealing beads on its underside, adapted to receive sealing compound, for engagement with the deck surface.

8. The invention as defined in claim 1, wherein:

(a) said centering shoulder has a substantially conical configuration adapted to seal against said skirt when the closure is screwed into the fitting, (b) said groove being disposed generally outside the location of said fitting skirt, (c) a gasket disposed in said groove, (d) said closure having an annular sealing surface engageable with the gasket to provide a supplementary seal therewith when the closure is screwed into the fitting, (e) said fitting comprising a tubular body adapted to be received in a hole in the deck, (f) said fitting securing means comprising an annular mounting flange engageable with the upper surfaces of the deck which surround said hole.

9. The invention as defined in claim 1, wherein:
(a) the buttress thread on the fitting comprises a single thread formation, extending circumferentially through an angle of substantially 360°.

10. The invention as defined in claim 1, wherein:
(a) said skirt lies generally along a cylindrical surface,
(b) said radial shifting occurring in directions generally transverse to said cylindrical surface.

11. The invention as defined in claim 1, wherein:
(a) said skirt has a curved upper surface, providing a small, generally circular contact area for high pressure engagement with cooperable surfaces of the centering shoulder, when the closure is screwed in place on the deck fitting.

12. A threaded access cover plate construction for the deck of a boat, comprising in combination:
(a) a deck fitting, having an annular mounting flange provided with mounting holes to enable the fitting to be secured to the deck of a boat,
(b) a screw closure receivable in the deck fitting,
(c) said fitting and screw closure having cooperable, mating buttress-type threads adapted to engage one another when the closure is screwed into the fitting,
(d) means defining a rim on the fitting,
(e) means defining a centering shoulder on said closure, cooperable with said rim,
(f) said cooperable buttress-type threads being dimensioned to provide excessive looseness for enabling lateral shifting of the closure with respect to the fitting, whereby the centering shoulder of the closure can precisely seat into the rim of the fitting when the closure is screwed into the latter,
(g) said buttress thread on the fitting being constituted of solely a single buttress thread formation, extending circumferentially through an angle of substantially 360° whereby the fitting can be molded in a single, two-part cavity with the parting line extending through the crest of the thread from its beginning to its end, the provision of said single buttress thread formation making for less difficulty in keeping the fitting clean since dirt on the thread can be quickly wiped away with a cloth while the fitting is secured in place.

* * * * *